US005977487A

United States Patent [19]

Kuhl

[11] Patent Number: 5,977,487

[45] Date of Patent: Nov. 2, 1999

[54] HIGH VOLTAGE INSULATOR OF CERAMIC MATERIAL HAVING SHRINK-FIT CAP AND METHOD OF MAKING

[75] Inventor: Martin Kuhl, Selb, Germany

[73] Assignee: Hoechst CeramTec Aktiengesellschaft, Selb, Germany

[21] Appl. No.: 08/997,010

[22] Filed: Dec. 23, 1997

Related U.S. Application Data

[63] Continuation of application No. 08/449,782, May 24, 1995, abandoned.

[30] Foreign Application Priority Data

Jun. 17, 1994 [DE] Germany ..... 44 21 343

[51] Int. Cl.[6] ..... H01B 17/00; H01B 17/50

[52] U.S. Cl. ..... 174/176; 174/137 A; 174/137 B; 174/178; 174/177; 174/181; 174/188

[58] Field of Search ..... 174/182, 176, 174/11 BH, 12 BH, 14 BH, 140 R, 140 C, 140 S, 141 R, 141 C, 142, 144, 150, 207, 208, 210, DIG. 10, 179, 194, 152 R, 177, 178

[56] References Cited

U.S. PATENT DOCUMENTS

| | | | |
|---|---|---|---|
| 1,031,453 | 7/1912 | Lange et al. | 174/208 |
| 1,769,262 | 7/1930 | Jansen | 174/31 R |
| 2,924,644 | 2/1960 | Cox | 174/179 |
| 3,194,879 | 7/1965 | Hopwood | 174/140 C |
| 4,845,318 | 7/1989 | Clabburn et al. | 174/178 |
| 5,563,379 | 10/1996 | Kunieda et al. | 174/169 |

OTHER PUBLICATIONS

A. Hecht. 5. "Form und Konstruktion von keramischen Bauteilen", Elektrokeramik, 1976, Springer–Verlag Berlin, p. 144–147, 158–159, 162–177, & 188–191.

*Primary Examiner*—Kristine Kincaid
*Assistant Examiner*—Mark Olds
*Attorney, Agent, or Firm*—Foley & Lardner

[57] ABSTRACT

The invention relates to a high voltage insulator of ceramic material, which includes a longitudinal shank having molded sheds and to whose ends of the shank metal caps are shrink-fitted. The ends of the longitudinal shank are enlarged so that the diameter of the enlarged ends is at least 1.05 times the diameter of the longitudinal shank. The cylindrical surface, and the end face of the enlarged ends of the longitudinal shank are machined.

21 Claims, 3 Drawing Sheets

HIGH VOLTAGE INSULATOR OF CERAMIC MATERIAL HAVING SHRINK-FIT CAP AND METHOD OF MAKING

This application is a continuation of application Ser. No. 08/449,782 filed on May 24, 1995, now abandoned.

BACKGROUND

1. Field of the Invention

The present invention relates to high-voltage insulators made from ceramic materials having a shank and ends where the ends are at least 1.05 times as thick as the shank. Caps are shrink-fit around the ends of the insulators to provide a tight seal.

2. Description of Related Art

High voltage insulators of ceramic materials are mainly used in outdoor switching stations and outdoor lines. They comprise an elongated insulation body which is equipped with shields for the formation of a leakage path which is matched, to the atmospheric conditions. The shields are moulded on the insulator shank whose thickness is determined by the mechanical requirements. At the ends of the insulation body or the insulator shank there are located metal caps via which the force transmission from the insulator shank to components leading further takes place. High voltage insulators are usually configured so as to have rotational symmetry, if the asymmetry of the caps, for example, as a result of individual links is ignored; the insulator caps concentrically surround the ends of the insulator shank. The mechanical loadability is determined not only by the shank diameter of the insulator, but also by the configuration of the shank ends, the manner in which the metal caps are fixed to the shank and the configuration and the material of the metal caps and also the type of mechanical stresses, which can, in principle, be tensile forces, compressive forces, flexurel forces and torsional forces or combinations of these forces. The constructions of the metal caps therefore depend on the type of stress prevailing in the particular case.

In the case of the known high voltage insulators, solid or hollow, the metal caps are slipped onto the insulator end to be reinforced and the gap between the insulator shank and the metal cap is filled with a setting filler material, such as various types of cement, lead or casting resin. The ends of the insulator body are here configured differently. Thus, the ends of tensile-stressed series path stabilizers (suspended insulators) have a conical configuration and are glazed and are frequently fixed in the metal cap by means of cast lead. In the case of post insulators subjected to flexural and/or torsional stresses, the insulation bodies are usually provided with cylindrical ends. The ends can here be made rough in various ways, e.g. fluted, spread with grit or corrugated. Portland cement is mainly used as filler material. The flexural strength of post insulators is strongly dependent on the ratio of filler depth to insulator shank diameter. Metal caps for suspended and post insulators usually comprise galvanized cast iron, because in the case of these insulators no great accuracy is required for the external dimensions. Where high demands are placed on the accuracy of the external dimensions of the insulators, the metal caps usually comprise aluminum alloys which have to be very accurately machined and require no additional corrosion protection after machining. To achieve the necessary precision of the insulator dimensions during cementing of the caps, efforts have to be made to relieve stresses in the positioning of the caps.

DE-A-36 43 651 discloses the shrink-fitting of the metal caps onto the ends of spherical-headed ceramic insulators. According to this method, the components are heated together, joined and cooled together, so that the ceramic workpiece is not damaged. This type of joining technique is very complicated for insulators, since hollow insulators in particular can have dimensions in the meter range. The invention is to provide a solution here.

SUMMARY OF THE INVENTION

It is accordingly an object of the invention to provide a high tension insulator of ceramic material which has precise dimensions and also keeps them, is simple and quick to reinforce and in which no chemical reactions occur between the material components. Furthermore, the mechanical strength of the insulator material should be fully exploited for as small as possible an insertion length of the insulator ends into the metal caps.

This object is achieved by means of a rotationally symmetric high voltage insulator of ceramic material having shrink caps fitted to the ends, wherein the ends of the insulator in the region of the joining surfaces are configured so as to be at least 1.05 times as thick as the shank diameter and these thickened ends are, after firing, machined cylindrically and on the end faces.

The end of the metal cap facing the insulator body can project over the thickened insulator end and have, on its end face, a stop which rests on the end face of the insulator. A glazed groove can be provided between the metal cap and the insulator shank and a phase having a height of at least 1.5 mm, preferably a height of 2–5 mm, can be provided on the end faces of the insulator. The use of glaze is to prevent pollution from adhering to the surface of the insulator surface and to provide a smooth surface. The thickened, machined insulator end and the inner surfaces of the metal caps can have a roughness $R_a$ of 0.5–100 $\mu$m, preferably 0.8–30 $\mu$m, particularly preferably 1–10 $\mu$m and the groove can be filled with a sealant, e.g. silicone rubber. The metal caps can be provided with flanges which have a groove for accommodating a seal. Metal caps can comprise cast aluminum, wrought aluminum alloys, corrosion-resistant steel materials or steel and cast materials having corrosion-protective surface coatings. Suitable ceramic materials are, in particular, porcelains, ceramics containing aluminum oxide, zirconium silicate, cordierite and steatite materials.

The advantages of the invention are essentially in the simple joining technique, the dimensional accuracy and the reproducibility of the mechanical loading values of the high voltage insulators, in particular for hollow insulators. For the latter, there is the advantage of simpler sealability.

The invention is illustrated below with the aid of the figures.

DETAILED DESCRIPTION

Figure 1:
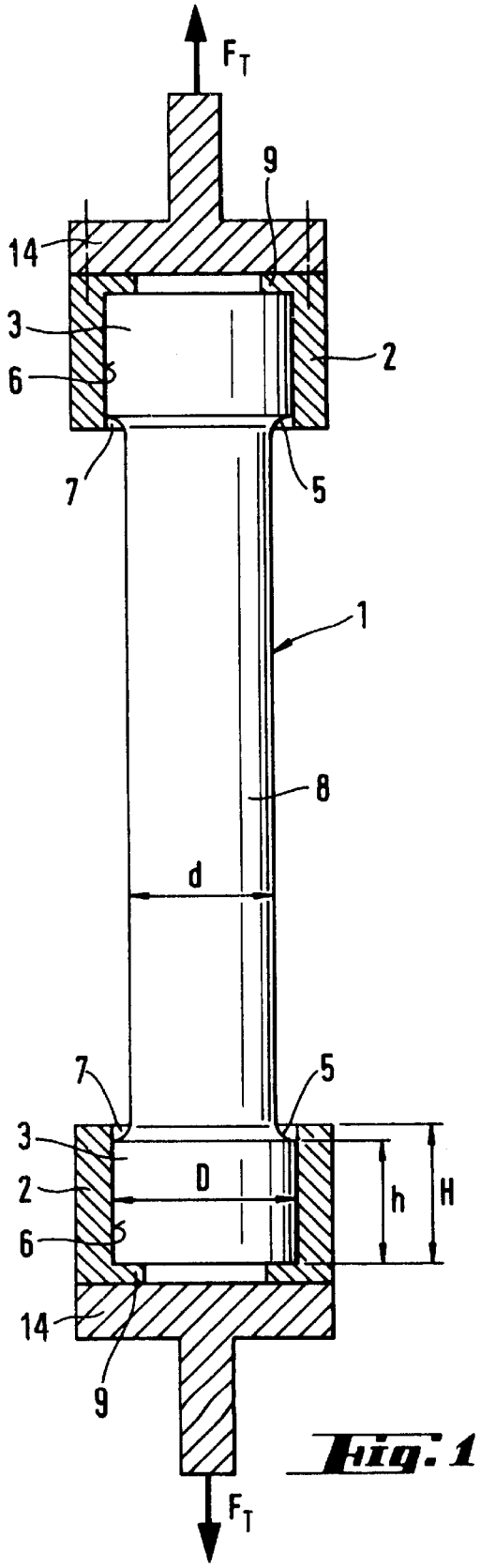
FIG. 1 shows a test specimen for tensile tests, partially sectioned.

Glazed, rotationally symmetric test specimens 1 having thickened, machined ends 3, so-called shoulder rods, were produced from aluminous porcelain. The rod diameter d was 75 mm, the diameter D of the ends 3 was 95 mm. The metal caps 2 comprised a wrought aluminum alloy. The ends 3 of the rods 1 were machined after firing on the circumference and on the end faces and had a roughness $R_a$ of 1.3–2.5 $\mu$m. The roughness $R_a$ of the metal caps 2 in the recess 6 was 1.2–1.5 $\mu$m. The diameter of the recess 6 was smaller than the diameter D of the ends 3; their height H was 65 mm and the height h of the ends 3 was 60 mm, resulting in formation of a groove 7 between cap and rod. The metal caps were heated to 250° C. then slipped onto the ends of the rods and cooled to 25° C., which resulted in formation of a metal-ceramic connection by shrinkage. Depending on the cap dimensions, a radial stress results in the ceramic, which stress can be calculated.

According to FIG. 1, the test specimens were subjected to an ultimate tensile strength test, with the tensile forces $F_T$ being applied in the direction of the arrows. T-shaped elements 14 are jaw elements used to draw test specimen 1 with the corresponding forces $F_T$ to determine the tensile strength. Fracture values between 190 and 230 kN were obtained, which corresponds to a tensile strength of the ceramic material of 43–52 N/mm$^2$. Fracture of these test specimens always occurred in the region of the groove 7, i.e. in the region of the transition from the shank 8 to the thickened shank end 3.

Figure 2:
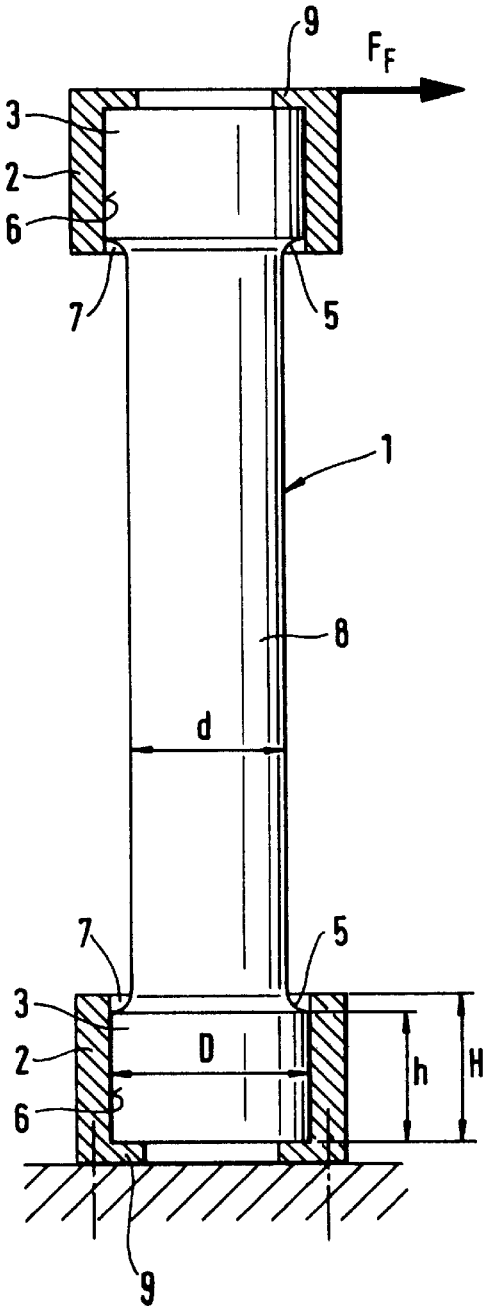
FIG. 2 shows a test specimen for flexural tests, partially sectioned.
Figure 3:
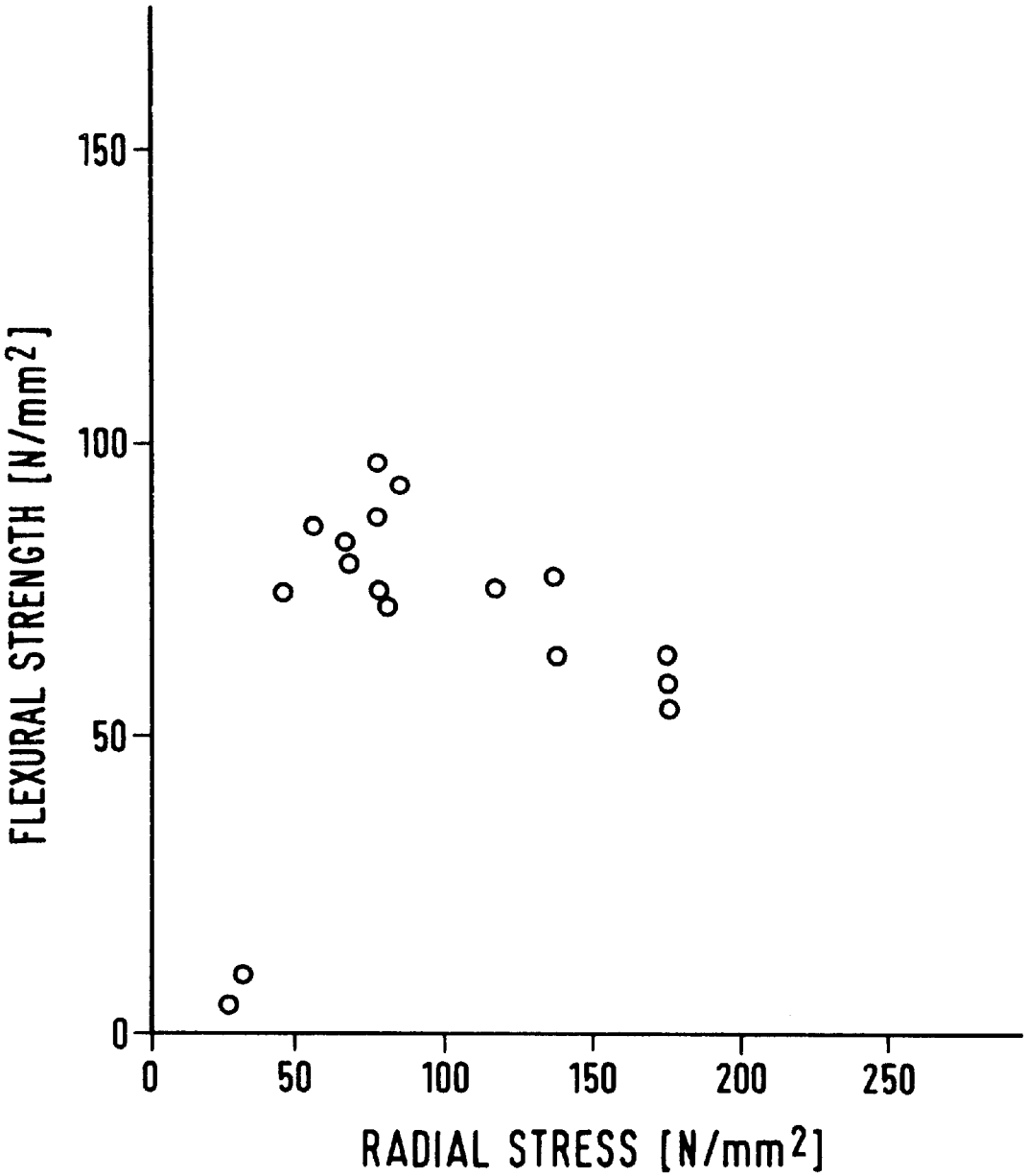
FIG. 3 shows the relationship between radial stress and flexural strength.

According to FIG. 2, the test specimens were subjected to a flexural strength test, with the flexural forces $F_F$ being applied in the direction of the arrow, giving the relationship between radial stress and flexural strength shown in FIG. 3. The strength values between 50 and 100 N/mm$^2$ are obtained from test specimens whose fracture point is in the region of the shoulder 5 of the groove 7. The low strength values (<20 N/mm$^2$) are attributable to circular fractures within the metal cap 2.

FIG. 3 shows a clear relationship between flexural strength and radial stress in the region of the point of connection, without the occurrence of scatter as observed according to the prior art. FIG. 3 also shows that radial stresses of>40 N/mm$^2$ are required for industrially interesting flexural strengths at ambient temperatures of 23° C. to 26° C. Tests in the temperature range from −25° C. to +125° C., i.e. in a temperature interval of 150°, confirm the reproducibility of the measured points in FIG. 3, with the radial stress not falling below 60 N/mm$^2$. It was thus able to be shown that metal caps shrink-fitted to the ends of high tension insulators according to the features of the invention can also be used outdoors where temperature differences in regions of extreme climate can be expected to be up to 100° C.

Figure 4:
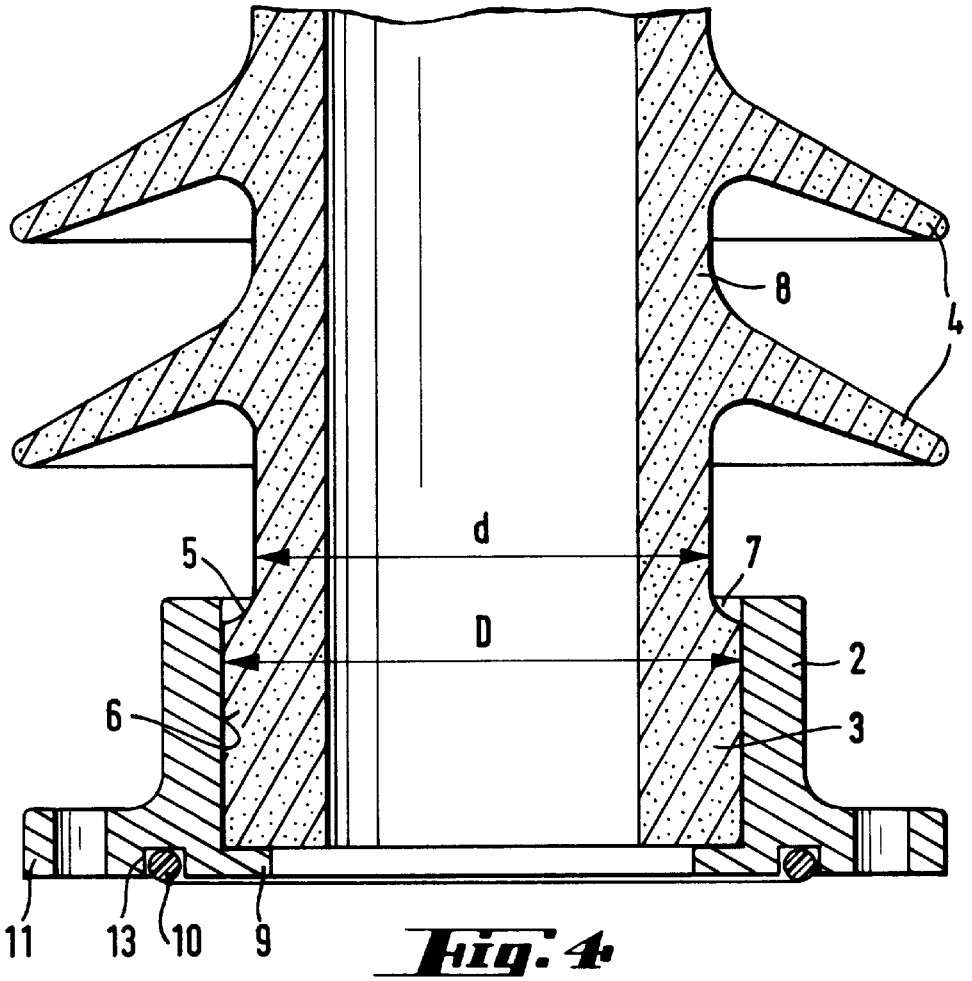
FIG. 4 shows, in section, part of a hollow post insulator.

In the hollow insulator of porcelain shown in FIG. 4, the shank 8 is provided with molded shields 4. The end 3 of the insulation body has a greater diameter D than the diameter d of the shank 8. By machining the outer circumferential surface of the end 3 and the end face of the end 3, the length of the insulation body can be made to conform to a predetermined value, and the surface roughness also can be adjusted to a predetermined value. The metal cap 2, preferably comprising an aluminum alloy or stainless steel, is arranged under radial stress on the machined end 3 of the insulation body. The metal cap 2 can be provided with a circumferential stop 9 which during the reinforcement of the insulation body rests on the end face of the end 3 of the insulation body. In this way, a precise dimension of the connection of the insulator is achieved. The mounting of the metal caps 2 is very simple. The heated metal caps are simply pushed onto the ends of the insulation body and then in a few seconds cool sufficiently for the insulator to be able to be handled immediately. After only about 30 minutes, the insulator can be mechanically tested without settling of the metal caps occurring.

Figure 5:
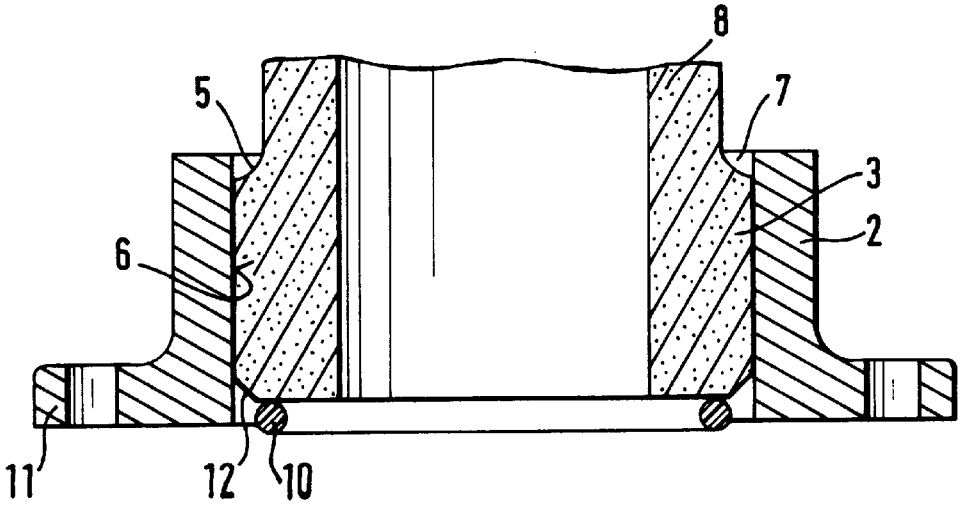
FIG. 5 shows a variant to FIG. 4.

The roughnesses of the joining surfaces of the shrink seat are of great importance, since the pulling off of the cap as a result of mechanical stressing depends not only on the radial stress in the shrink seat, but also on the coefficient of friction between the joining surfaces. It has been found that a roughness $R_a$ of 1–10 $\mu$m is particularly advantageous for the pairing aluminum/porcelain. Of great importance in hollow insulators is also the sealing to components which are fixed to the hollow insulator of porcelain. It has been found that roughnesses of the pairing aluminum/porcelain of 1–10 $\mu$m are impermeable to water and gas, so that seals 10 can also be arranged in a groove 13 in the flange 11 of the metal cap 2 (FIG. 4). If the joint is permeable however, seals 10 can also, as shown in FIG. 5, be arranged on the end face of the end 3 of the insulation body. That is, when the roughness of the aluminum and porcelain pairings are such that the joint between them is impermeable to water and gas, the seal does not have to placed at the joint of these two surfaces. Rather, the seal can be placed in groove 13 in flange 11 of the metal cap, as shown in FIG. 4. On the other hand, if the joint is permeable to water and gas, then the seal would be placed at the end face of end 3 of the insulation body, as shown in FIG. 5.

For the joining process, it is advantageous, as shown in FIG. 5, to provide the end 3 of the insulation body with a chamfer 12 having a height of at least 1.5 mm and an included angle of 2–45 degrees, in particular 5–30 degrees, with the insulator axis. It will be appreciated that a cylinder that has no chamfer on its front end can only be inserted with great difficulty into a tube with an inside diameter that is slightly larger than the diameter of the cylinder. A chamfer at the front end of a cylinder reduces the diameter of the cylinder at the end and gives it a slight tapered shape which substantially facilitates installation.

The detailed studies on the shrink connection with the insulator end have shown that any movement between the insulator and the metal cap has to be avoided under any circumstances. To meet this condition even for the region where the point of highest mechanical stress for the insulation material is located, namely in the transition region from end 3 to shank 8, it is advantageous to select the height H of the cap 2 so as to be greater than the height h of the end 3 of the insulation body. The groove 7 formed in this way can be filled with a single-component silicone rubber to avoid formation of pools of water. Silicone rubbers based on acetoxyacetic acid have excellent adhesion to aluminum and glazed porcelain.

The glazed groove 7 forms a preferential point of fracture under high mechanical stress owing to its notch effect. Since the position of the preferential point of fracture depends of the projecting length of the cap 2, it is advantageous to make the groove 7 as flat as possible and to provide it with a radius on the insulator shank.

The invention has been illustrated for the example of the hollow insulator, because it can be applied most advantageously here. Of course, high voltage insulators according to the invention can also be configured as solid post insulators or as suspended insulators. Other applications of the invention for components of very high precision, e.g. for switching and actuator rods for electrical high voltage installations are possible.

What is claimed is:

1. A high voltage insulator comprised of ceramic material, wherein the insulator comprises:

a longitudinal shank having a diameter (d) and sheds molded thereon;

enlarged ends disposed axially on the longitudinal shank, each of the enlarged ends having a cylindrical joining surface and an end face, where the diameter (D) of each of the enlarged ends is at least 1.05 times greater than the diameter (d) of the longitudinal shank and where the cylindrical joining surface and the end face of each of the enlarged ends are machined;

metal caps disposed concentrically around the enlarged ends of the longitudinal shank and shrink-fitted thereon, the metal caps having inner joining faces that contact the cylindrical joining surfaces of the enlarged ends of the longitudinal shank forming a point of connection between said longitudinal shank and each of said metal caps;

wherein ends of the metal caps facing the longitudinal shank project beyond the enlarged ends of the longitudinal shank to form grooves between the metal caps and the longitudinal shank; and wherein radial stresses in a region of the point of connection are>40 $N/mm^2$.

2. The high voltage insulator as claimed in claim 1, wherein the metal caps further comprise stops that rest on the end faces of the enlarged ends of the longitudinal shank.

3. The high voltage insulator as claimed in claim 1, wherein the insulator is rotationally symmetric.

4. The high voltage insulator as claimed in claim 1, wherein each of the grooves is a glazed groove.

5. The high voltage insulator as claimed in claim 1, wherein the enlarged ends further comprise a chamfer on each of the end faces having a height of at least 1.5 mm.

6. The high voltage insulator as claimed in claim 1, wherein the enlarged ends have a surface roughness of from 0.5 to 100 $\mu$m.

7. The high voltage insulator as claimed in claim 6, wherein the enlarged ends have a surface roughness of from 0.8 to 30 $\mu$m.

8. The high voltage insulator as claimed in claim 6, wherein the enlarged ends have a surface roughness of from 1 to 10 $\mu$m.

9. The high voltage insulator as claimed in claim 1, wherein each of the grooves between the ends of the caps and the longitudinal shank is filled with a sealant.

10. The high voltage insulator as claimed in claim 1, wherein each of the metal caps further comprise a flange having a groove for accommodating a seal.

11. The high voltage insulator as claimed in claim 1, wherein the inner joining faces of the metal caps have a surface roughness of from 0.5 to 100 $\mu$m.

12. The high voltage insulator as claimed in claim 1, wherein the metal caps are comprised of a material selected from the group consisting of cast aluminum, wrought aluminum alloy, corrosion-resistant steel and steel or cast materials having corrosion-protective coatings.

13. The high voltage insulator as claimed in claim 1, prepared by a process comprising:

machining the cylindrical joining surfaces and end faces of the enlarged ends of the longitudinal shaft to a surface roughness of from 0.5 to 100 $\mu$m;

machining the inner joining faces of the metal caps to a surface roughness of from 0.5 to 100 $\mu$m;

heating the metal caps;

placing the metal caps over the enlarged ends of the longitudinal shank; and cooling the metal caps and enlarged ends of the longitudinal shank so as to shrink fit the metal caps on the enlarged ends.

14. A method of making a high voltage insulator as claimed in claim 10, comprising:

machining the cylindrical joining surfaces of the enlarged ends and end faces of the enlarged ends of the longitudinal shaft to a surface roughness of from 0.5 to 100 $\mu$m;

machining the inner joining faces of the metal caps to a surface roughness of from 0.5 to 100 $\mu$m;

heating the metal caps;

placing the metal caps over the enlarged ends of the longitudinal shank; and cooling the metal caps and enlarged ends of the longitudinal shank so as to shrink fit the metal caps on the enlarged ends.

15. The method as claimed in claim 14, wherein the cylindrical joining surfaces are machined to have a surface roughness of from 0.8 to 30 $\mu$m.

16. The method as claimed in claim 15, wherein the cylindrical joining surfaces are machined to have a surface roughness of from 1 to 10 $\mu$m.

17. The method as claimed in claim 14, wherein the joining faces of the metal caps are machined to have a surface roughness of from 0.8 to 30 $\mu$m.

18. The method as claimed in claim 17, wherein the cylindrical joining surfaces are machined to have a surface roughness of from 1 to 10 $\mu$m.

19. The method as claimed in claim 14, wherein the metal caps are heated to a temperature of 250° C.

20. The method as claimed in claim 19, wherein the metal caps and enlarged ends of the longitudinal shank are cooled to a temperature of 20° C.

21. The high voltage insulator as claimed in claim 1, wherein the point of connection is over the metal caps entire inner joining faces and cylindrical joining surfaces of the enlarged end.

* * * * *